US007698982B2

(12) United States Patent
Bell

(10) Patent No.: US 7,698,982 B2
(45) Date of Patent: Apr. 20, 2010

(54) EXPLOSIVE PIPE SEVERING TOOL

(75) Inventor: William T. Bell, Huntsville, TX (US)

(73) Assignee: Titan Specialties, Ltd., Pampa, TX (US)

( * ) Notice: Subject to any disclaimer, the term of this patent is extended or adjusted under 35 U.S.C. 154(b) by 123 days.

(21) Appl. No.: 11/442,807

(22) Filed: May 30, 2006

(65) Prior Publication Data

US 2006/0266205 A1 Nov. 30, 2006

Related U.S. Application Data

(60) Division of application No. 10/762,182, filed on Jan. 21, 2004, now Pat. No. 7,530,397, which is a continuation of application No. 09/949,990, filed on Sep. 10, 2001, now abandoned.

(51) Int. Cl.
*F42B 3/10* (2006.01)

(52) U.S. Cl. ..... 89/1.15; 166/55; 102/321.1

(58) Field of Classification Search ..... 89/1.15; 166/55–55.8
See application file for complete search history.

(56) References Cited

U.S. PATENT DOCUMENTS 4,290,486 A * 9/1981 Regalbuto ..... 166/297
4,298,063 A * 11/1981 Regalbuto et al. ..... 166/55
4,378,844 A * 4/1983 Parrish et al. ..... 166/297
4,537,255 A * 8/1985 Regalbuto et al. ..... 166/297
4,667,599 A * 5/1987 Brand ..... 102/275.4
5,095,801 A * 3/1992 Lopez de Cardenas ..... 89/1.15
5,159,145 A * 10/1992 Carisella et al. ..... 89/1.15
5,223,665 A * 6/1993 Burleson et al. ..... 102/312
5,571,986 A * 11/1996 Snider et al. ..... 102/275.11
5,631,437 A * 5/1997 LaVigna et al. ..... 89/14.3
5,730,462 A * 3/1998 Jackson et al. ..... 280/741
6,167,957 B1 * 1/2001 Frazier ..... 166/55.2
6,397,752 B1 * 6/2002 Yang et al. ..... 102/275.4
6,412,388 B1 * 7/2002 Frazier ..... 89/1.15
2005/0268776 A1 * 12/2005 Bell ..... 89/1.15
2006/0266205 A1 * 11/2006 Bell ..... 89/1.15

* cited by examiner

*Primary Examiner*—Troy Chambers
(74) *Attorney, Agent, or Firm*—W. Allen Marcontell

(57) ABSTRACT

A pipe severing tool is arranged to align a plurality of high explosive pellets along a unitizing support structure whereby all explosive pellets are inserted within or extracted from a tubular housing as a singular unit. Electrically initiated exploding wire detonators (EBW) are positioned at opposite ends of the tubular housing for simultaneous detonation by a capacitive firing device. The housing assembly includes a detachable bottom nose that permits the tool to be armed and disarmed without disconnecting the detonation circuitry. Because the tool is not sensitive to stray electrical fields, it may be transported, loaded and unloaded with the EBW detonators in place and connected.

11 Claims, 2 Drawing Sheets

EXPLOSIVE PIPE SEVERING TOOL

CROSS REFERENCE TO RELATED APPLICATIONS

This application is a Division of application Ser. No. 10/762,182 filed Jan. 21, 2004 now U.S. Pat. No. 7,530,397. Said application Ser. No. 10/762,182 is a Continuation of application Ser. No. 09/949,990 filed Sep. 10, 2001 now abandoned.

STATEMENT REGARDING FEDERALLY SPONSORED RESEARCH OR DEVELOPMENT

Not applicable.

BACKGROUND OF THE INVENTION

1. Field of the Invention

The present invention relates to the earthboring arts. More particularly, the invention relates to methods and devices for severing drill pipe, casing and other massive tubular structures by the remote detonation of an explosive cutting charge.

2. Description of Related Art

Deep well earthboring for gas, crude petroleum, minerals and even water or steam requires tubes of massive size and wall thickness. Tubular drill strings may be suspended into a borehole that penetrates the earth's crust several miles beneath the drilling platform at the earth's surface. To further complicate matters, the borehole may be turned to a more horizontal course to follow a stratification plane.

The operational circumstances of such industrial enterprise occasionally presents a driller with a catastrophe that requires him to sever his pipe string at a point deep within the wellbore. For example, a great length of wellbore sidewall may collapse against the drill string causing it to wedge tightly in the well bore. The drill string cannot be pulled from the well bore and in many cases, cannot even be rotated. A typical response for salvaging the borehole investment is to sever the drill string above the obstruction, withdraw the freed drill string above the obstruction and return with a "fishing" tool to free and remove the wedged portion of drill string.

When an operational event such as a "stuck" drill string occurs, the driller may use wireline suspended instrumentation that is lowered within the central, drill pipe flow bore to locate and measure the depth position of the obstruction. This information may be used to thereafter position an explosive severing tool within the drill pipe flow bore.

Typically, an explosive drill pipe severing tool comprises a significant quantity, 800 to 1,500 grams for example, of high order explosive such as RDX, HMX or HNS. The explosive powder is compacted into high density "pellets" of about 22.7 to about 38 grams each. The pellet density is compacted to about 1.6 to about 1.65 gms/cm$^3$ to achieve a shock wave velocity greater than about 30,000 ft/sec, for example. A shock wave of such magnitude provides a pulse of pressure in the order of $4\times10^6$ psi. It is the pressure pulse that severs the pipe.

In one form, the pellets are compacted at a production facility into a cylindrical shape for serial, juxtaposed loading at the jobsite as a column in a cylindrical barrel of a tool cartridge. Due to weight variations within an acceptable range of tolerance between individual pellets, the axial length of explosive pellets fluctuates within a known tolerance range. Furthermore, the diameter-to-axial length ratio of the pellets is such that allows some pellets to wedge in the tool cartridge barrel when loaded. For this reason, a go-no-go type of plug gauge is used by the prior art at the end of a barrel to verify the number of pellets in the tool barrel. In the frequent event that the tool must be disarmed, the pellets may also wedge in the barrel upon removal. A non-sparking depth-rod is inserted down the tool barrel to verify removal of all pellets.

Extreme well depth is often accompanied by extreme hydrostatic pressure. Hence, the drill string severing operation may need to be executed at 10,000 to 20,000 psi. Such high hydrostatic pressures tend to attenuate and suppress the pressure of an explosive pulse to such degree as to prevent separation.

One prior effort by the industry to enhance the pipe severing pressure pulse and overcome high hydrostatic pressure suppression has been to detonate the explosive pellet column at both ends simultaneously. Theoretically, simultaneous detonations at opposite ends of the pellet column will provide a shock front from one end colliding with the shock front from the opposite end within the pellet column at the center of the column length. On collision, the pressure is multiplied, at the point of collision, by about 4 to 5 times the normal pressure cited above. To achieve this result, however, the detonation process, particularly the simultaneous firing of the detonators, must be timed precisely in order to assure collision within the explosive column at the center.

Such precise timing is typically provided by means of mild detonating fuse and special boosters. However, if fuse length is not accurate or problems exist in the booster/detonator connections, the collision may not be realized at all and the device will operate as a "non-colliding" tool with substantially reduced severing pressures.

The reliability of state-of-the-art severing tools is further compromised by complex assembly and arming procedures required at the well site. With those designs, regulations require that explosive components (detonator, pellets, etc.) must be shipped separately from the tool body. Complete assembly must then take place at the well site under often unfavorable working conditions.

Finally, the electric detonators utilized by state-of-the-art severing tools are not as safe from the electric stray currents and RF energy points of view, further complicating the safety procedures that must be observed at the well site.

SUMMARY OF THE INVENTION

The pipe severing tool of the present invention comprises an outer housing that is a thin wall metallic tube of such outside diameter that is compatible with the drill pipe flow bore diameter intended for use. The upper end of the housing tube is sealed with a threaded plug having insulated electrical connectors along an axial aperture. The housing upper end plug is externally prepared to receive the intended suspension string such as an electrically conductive wireline bail or a continuous tubing connecting sub.

The lower end of the outer housing tube is closed with a tubular assembly that includes a stab fit nose plug. The nose plug assembly includes a relatively short length of heavy wall tube extending axially out from an internal bore plug. The bore plug penetrates the barrel of the housing tube end whereas the tubular portion of the nose plug extends from the lower end of the housing tube. The bore plug is perimeter sealed by high pressure O-rings and secured by a plurality of set screws around the outside diameter of the outer housing tube.

The tubular portion of the nose plug provides a closed chamber space for enclosing electrical conductors. The bore plug includes a tubular aperture along the nose plug axis that is a load rod alignment guide. Laterally of the load rod alignment guide is a socket for an exploding bridge wire (EBW) detonator or an exploding foil initiator (EFI).

Within the upper end of the outer housing barrel is an inner tubular housing for an electronic detonation cartridge having a relatively high discharge voltage, 5,000 v or more, for example. Below the inner tubular housing is a cylindrical, upper detonator housing. The upper detonator housing is resiliently separated from the lower end of the inner tubular housing by a suitable spring. The upper detonator housing includes a receptacle socket 31 for an exploding bridge wire (EBW) detonator. The axis for the upper detonator receptacle socket is laterally offset from the outer housing barrel axis.

Preferably, the severing tool structure is transported to a working location in a primed condition with upper and lower EBW detonators connected for firing but having no high explosive pellets placed between the EBW detonators. At the appropriate moment, the nose plug assembly is removed from the bottom end of the outer housing and a load rod therein removed. The upper distal end of the load rod includes a circumferential collar such as a snap ring. The opposite end of the load rod is visually marked to designate maximum and minimum quantities of explosive aligned along the load rod.

Explosive pellets for the invention are formed as solid cylinder sections having an axial aperture. The individual pellets are stacked along the load rod with the load rod penetrating the axial aperture. The upper distal end collar serves as a stop limit for the pellets which are serially aligned along the rod until the lower face of the lowermost pellet coincides with the max/min indicia marking. A restriction collar such as a resilient O-ring is placed around the loading rod and tightly against the bottom face of the lowermost explosive pellet.

The rod and pellet assembly are inserted into the outer housing barrel until the uppermost pellet face contiguously engages the upper detonator housing. The rod guide aperture in the nose plug is then assembled over the lower distal end of the load rod and the lower detonator brought into contiguous engagement with the lowermost pellet face. The assembly is then further compressed against the loading spring between the inner tubular housing and the upper detonator housing until abutment between the nose plug shoulder and the lower distal end of the outer housing tube.

In the event that the invention severing tool must be disarmed, all pellets may be removed from the housing barrel as a singular unit about the load rod. This is accomplished by removing the lower nose plug which exposes the lower end of the load rod. By grasping and pulling the load rod from the housing barrel, all pellets that are pinned along the load rod below the upper distal end collar are drawn out of the housing tube with the rod.

BRIEF DESCRIPTION OF THE DRAWINGS

Relative to the drawings wherein like reference characters designate like or similar elements or steps through the several figures of the drawings.

DESCRIPTION OF THE PREFERRED EMBODIMENTS

Figure 1:
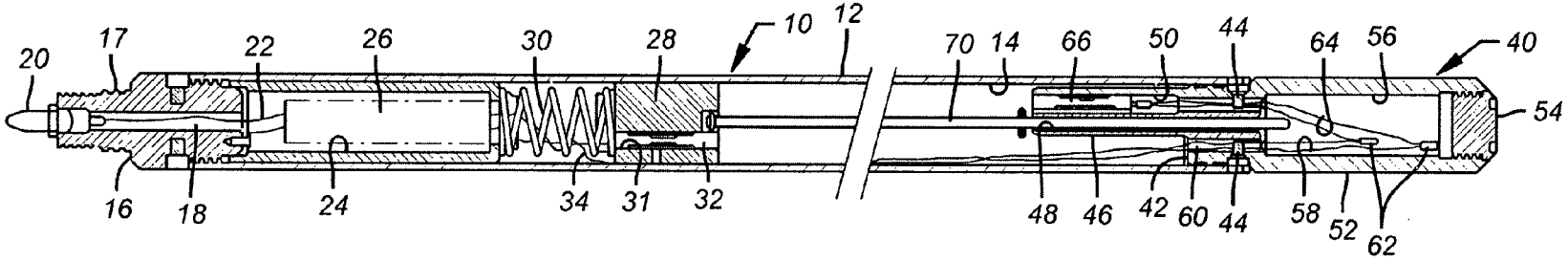
FIG. 1 is a sectional view of the invention as assembled without an explosive charge for transport.

Referring to the FIG. 1 cross-sectional view of the invention 10, a tubular outer housing 12 having an internal bore 14 is sealed at an upper end by a plug 16. The plug 16 includes an axial bore 18 and an electrical connector 20 for routing detonation signal leads 22. A boss 17, projecting from the base of the plug, is externally threaded for the attachment of the desired suspension string such as an electrical wireline or service tubing.

An inner housing tube 24 is secured to and extends from the upper end plug 16 into the internal bore 14 of the outer housing 12. The inner housing tube 24 encloses a capacitive firing cartridge 26. Below the inner housing 24 is an upper detonator housing 28. A coil spring 30 links the upper detonator housing 28 to the inner housing tube 24. An exploding bridge wire (EBW) detonator or exploding foil initiator (EFI) 32 is seated within a receptacle socket formed in the upper detonator housing 28 laterally of the housing axis. Electrical conduits 34 connect the capacitive firing cartridge 26 to the EBW detonator or EFI 32.

An exploding bridge wire (EBW) detonator comprises a small quantity of moderate to high order explosive that is detonated by the explosive vaporization of a metal filament or foil (EFI) due to a high voltage surge imposed upon the filament. A capacitive firing cartridge is basically an electrical capacitor discharge circuit that functions to abruptly discharge with a high threshold voltage. Significantly, the EBW detonator or EFI is relatively insensitive to static or RF frequency voltages. Consequently, the capacitive firing circuit and EBW or EFI function cooperatively to provide a substantial safety advantage. An unusually high voltage surge is required to detonate the EBW detonator (or EFI) and the capacitive firing cartridge delivers the high voltage surge in a precisely controlled manner. The system is relatively impervious to static discharges, stray electrical fields and radio frequency emissions. Since the EBW and EFI detonation systems are, functionally, the same, hereafter and in the attached invention claims, reference to an EBW detonator is intended to include and encompass an EFI.

The lower end of the outer housing tube 12 is operatively opened and closed by a nose plug 40. The nose plug 40 comprises a plug base 42 having an O-ring fitting within the lower end of the outer housing bore 14. The plug base 42 may be secured to the outer housing tube 12 by shear pins or screws 44 to accommodate a straight push assembly. Projecting from the interior end of the plug base is a guide tube boss 46 having an axial throughbore 48 and a receptacle socket 50 for a detonator cap 66.

Projecting from the exterior end of the plug base 42 is a heavy wall nose tube 52 having a nose cap 54. The nose cap 54 may be disassembled from the nose tube 52 for manual access into the interior bore 56 of the nose tube 52. Detonation signal conductor leads 58 are routed from the firing cartridge 26, through the upper detonator housing and along the wall of housing bore 14. A conductor channel 60 routes the leads 58 through the nose plug base 42 into the nose tube interior 56. This nose tube interior provides environmental protection for electrical connections 62 with conductor leads 64 from the lower EBW detonator 66.

Although the electrical connections of both EBW detonators 32 and 66 are field accessible, it is a design intent for the invention to obviate the need for field connections. Without explosive pellet material in the outer housing bore 14, EBW detonators 32 and 66 are the only explosive material in the assembly. Moreover, the separation distance between the EBW detonators 32 and 66 essentially eliminates the possibility of a sympathetic detonation of the two detonators. Consequently, without explosive material in the tubing bore 14, the assembly as illustrated by FIG. 1 is safe for transport with the EBW detonators 32 and 66 connected in place.

The significance of having a severing tool that requires no detonator connections at the well site for arming cannot be minimized. Severing tools are loaded with high explosive at the well site of use. Often, this is not an environment that contributes to the focused, intellectual concentration that the hazardous task requires. Exacerbating the physical discomfort is the emotional distraction arising from the apprehension of intimately manipulating a deadly quantity of highly explosive material. Hence, the well site arming procedure should be as simple and error-proof as possible. Complete elimination of all electrical connection steps is most desirable.

Figure 2:
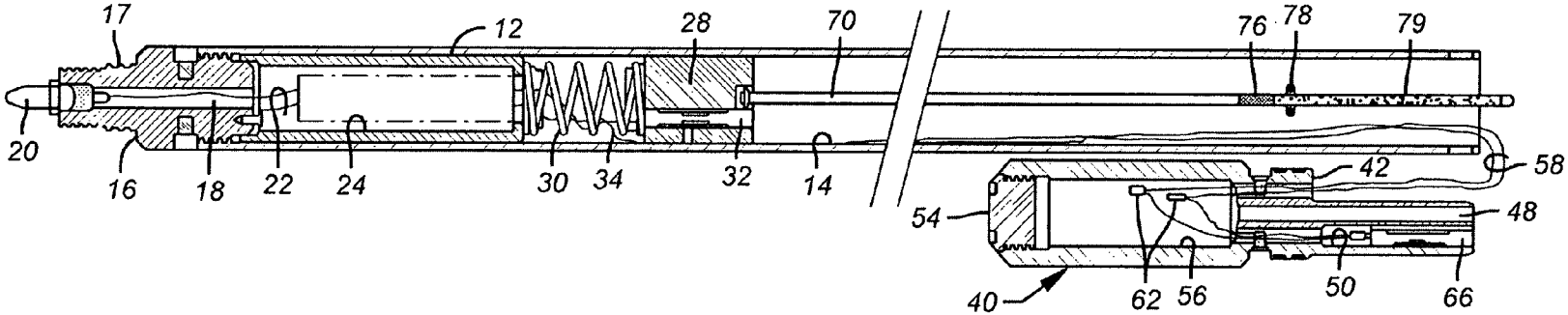
FIG. 2 is a sectional view of the invention with the bottom nose piece detached from the main assembly housing.
Figure 3:
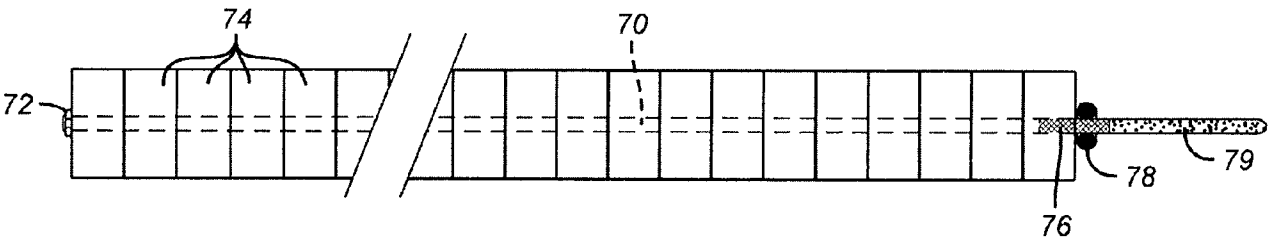
FIG. 3 is a sectional view of an assembled, explosive pellet unit.
Figure 4:
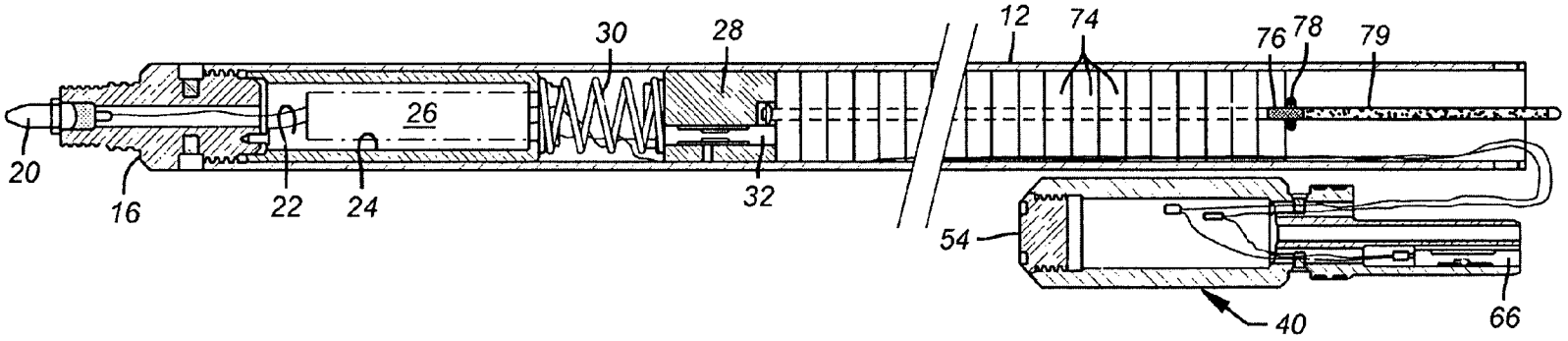
FIG. 4 is a sectional view of the invention with the explosive pellet unit combined with the main assembly housing but the bottom nose piece detached therefrom.

The load rod 70, best illustrated by FIGS. 2, 3 and 4, is preferably a stiff, slender shaft having an end retainer 72 such as a "C" clip or snap ring. Preferably, the shaft is fabricated from a non-sparking material such as wood, glass composite or non-ferrous metal. Individual high explosive "pellets" 74 are cylindrically formed with a substantially uniform outer perimeter OD and a substantially uniform ID center bore. The term "pellets" as used herein is intended to encompass all appropriate forms of explosive material regardless of the descriptive label applied such as "cookies", "wafers", or "charges". The axial length of the pellets may vary within known limits, depending on the exact weight quantity allocated to a specific pellet. The pellets are assembled as a serial column over the rod 70 which penetrates the pellet center bore. A prior calculation has determined the maximum and minimum cumulative column length depending on the known weight variations. This maximum and minimum column length is translated onto the rod 70 as an indicia band 76. The maximum and minimum length dimensions are measured from the rod end retainer 72. The OD of the end retainer 72 is selected to be substantially greater than the ID of the pellet center bore. Hence the pellets cannot pass over the end retainer and can slide along the rod 70 length no further than the end retainer. When loading the tool with explosive in the field, the correct quantity of explosive 74 will terminate with a lower end plane that coincides within the indicia band 76. An elastomer O-ring 78 constricted about the shaft of rod 70 compactly confines the pellet assembly along the rod length.

A lower distal end portion 79 of the rod extends beyond the indicia band 76 to penetrate the guide bore 48 of the bore plug base 42 when the bottom nose plug 40 is replaced after an explosive charge has been positioned. This rod extension allows the high explosive to be manually manipulated as a singular, integrated unit. In full visual field, the explosive charge is assembled by a columned alignment of the pellets over the penetrating length of the rod. When the outside surface plane of the last pellet in the column aligns within the indicia band 76, the lower end retainer 78 is positioned over the rod and against the last pellet surface plane to hold the column in tight, serial assembly. Using the rod extension 79 as a handle, the explosive assembly is axially inserted into the housing bore 14 until contiguous contact is made with the lower face of the upper detonator housing 28.

One of the synergistic advantages to the unitary rod loading system of the invention is use of lighter, axially shorter pellets. i.e. 22.7 gms. These lighter weight pellets enjoy a more favorable shipping classification (UN 1.4S) than that imposed on heavier, 38 gm pellets (UN 1.4D). In a prior art severing tool, the lighter weight pellets would be avoided due to "cocking" in the tool barrel 14 during loading. The loading rod system of the present invention substantially eliminates the "cocking" problem, regardless of how thin the pellet is.

Figure 5:
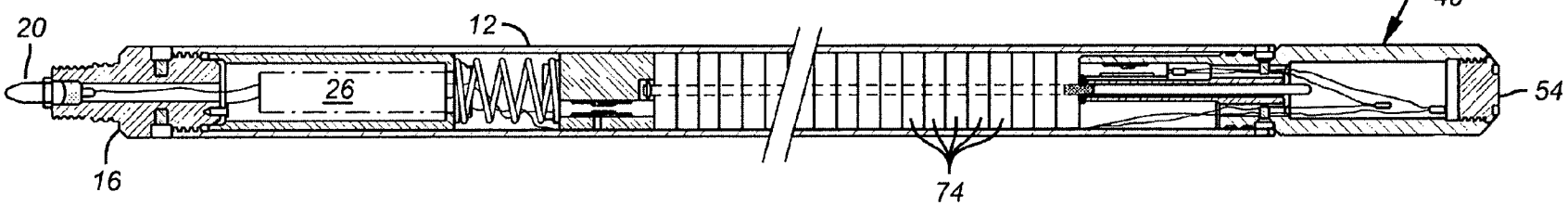
FIG. 5 is a sectional view of the invention in operative assembly with an explosive pellet unit.

With the explosive assembly in place, the lower end of the housing is closed by placement of the nose plug 40 into the open end of the housing. The rod end projection 79 penetrates the guide bore 48 as the plug base 42 is pushed to an internal seal with the housing bore 14. To assure intimate contact of the opposite end EBW detonators 32 and 66 with the respective adjacent ends of the explosive assembly, the upper detonator housing 28 is displaced against the spring 30 to accommodate the specified length of the explosive column. Accordingly, when the nose plug 40 is seated against the end of the outer housing tube 12, both EBW detonators are in oppositely mutual compression as is illustrated by FIG. 5. The severing tool is now prepared for lowering into a well for the pipe cutting objective Presently applied Explosive Safety Recommendations require the severing tool 10 to be electrically connected to the suspension string i.e. wireline, etc., before arming ballistically. Ballistic arming with respect to the present invention means the insertion of the explosive Pellets 24 into the housing bore 14.

On those occasions when the severing tool must be disarmed without discharge, it is only necessary to remove the nose plug 40 and by grasping the rod extension 79, draw the pellets 74 from the tube bore 14 as a single, integrated item.

Numerous modifications and variations may be made of the structures and methods described and illustrated herein without departing from the scope and spirit of the invention disclosed. Accordingly, it should be understood that the embodiments described and illustrated herein are only representative of the invention and are not to be considered as limitations upon the invention as hereafter claimed.

The invention claimed is:

1. A method of severing a length of pipe comprising the steps of:

providing a tubular barrel space for assembling a column of highly explosive material;

providing exploding wire detonators at opposite ends of said tubular barrel space;

providing a capacitive firing device for selectively igniting said detonators substantially simultaneously;

providing electrical continuity connections between said capacitive firing device and said exploding wire detonators;

assembling a column of highly explosive material within said tubular barrel space subsequent to said continuity connections between said capacitive firing device and said detonators;

engaging opposite ends of said explosive material column with said exploding wire detonators;

applying a resilient compression bias against said explosive material column between said electrically initiated detonators;

positioning said tubular barrel within an internal flow bore of a pipe at a predetermined location along a length of said flow bore; and, electrically initiating said detonators.

2. A method as described by claim 1 wherein said column of explosive material is assembled externally of said tubular barrel and positioned into said barrel space as an integral unit.

3. A method as described by claim 1 wherein said column of explosive material is assembled as a plurality of explosive pellets.

4. A method as described by claim 1 wherein said explosive pellets are assembled independently of said tubular barrel and unitized by structure independent of said tubular barrel.

5. A method as described by claim 4 wherein said explosive pellets are provided with central apertures for receiving a central rod structure.

6. A method of severing a length of pipe comprising the steps of:

providing a tubular barrel space for assembling a column of highly explosive material;

providing electrically initiated detonators at opposite ends of said tubular barrel space;

providing a capacitive firing device within said tubular barrel space for selectively igniting said detonators substantially simultaneously;

providing electrical continuity connections between said capacitive firing device and said detonators;

assembling a column of highly explosive material within said tubular barrel space subsequent to said continuity connections between said capacitive firing device and said detonators;

engaging opposite ends of said explosive material column with said electrically initiated detonators;

applying a resilient compression bias against said explosive material column between said electrically initiated detonators;

positioning said tubular barrel within an internal flow bore of a pipe at a predetermined location along a length of said flow bore; and, electrically initiating said detonators.

7. A method of severing a length of pipe as described by claim 6 wherein said electrically initiated detonators are exploding foil initiators.

8. A method of severing a length of pipe as described by claim 6 wherein said electrically initiated detonators are exploding bridge wire detonators.

9. A method as described by claim 6 wherein said column of explosive material is assembled externally of said tubular barrel and positioned into said barrel space as an integral unit.

10. A method as described by claim 9 wherein said column of explosive material is assembled as a plurality of explosive pellets.

11. A method as described by claim 10 wherein said explosive pellets are provided with central apertures for receiving a central rod structure.

* * * * *